United States Patent [19]

Klingesberger

[11] Patent Number: 4,761,985

[45] Date of Patent: Aug. 9, 1988

[54] APPARATUS FOR FLANGING SHEET METAL BLANKS

[75] Inventor: Johann Klingesberger, Lohnsburg, Austria

[73] Assignee: Voest-Alpine Aktiengesellschaft, Linz, Austria

[21] Appl. No.: 85,534

[22] Filed: Aug. 14, 1987

[30] Foreign Application Priority Data

Aug. 14, 1986 [AT] Austria ..... 2192/86

[51] Int. Cl.[4] ..... B21D 5/04

[52] U.S. Cl. ..... 72/316; 72/319; 72/481; 72/389

[58] Field of Search ..... 72/319, 320, 316, 322, 72/293, 481, 482, 413, 389

[56] References Cited

U.S. PATENT DOCUMENTS 4,112,731 9/1978 Anderson et al. ..... 72/320
4,532,792 8/1985 Hongo ..... 72/319
4,660,402 4/1987 Hongo ..... 72/319

FOREIGN PATENT DOCUMENTS 105091 4/1984 European Pat. Off. .

*Primary Examiner*—Daniel C. Crane
*Attorney, Agent, or Firm*—Kurt Kelman

[57] ABSTRACT

In apparatus for flanging sheet metal blanks, a holding-down mechanism comprises a holding-down ram (3) and a holding-down shoe (4), which comprises a plurality of displaceable segments (6), which are mounted on said ram for a displacement along a track, which is carried by the ram (3) and parallel to the line of bend. The displaceable segments are displaceable along said track by adjusting rod means (17). To permit the displaceable segments to be displaced in a simple manner, each displaceable segment (6) has associated therewith a coupling (19) for non-displaceably connecting each displaceable segment (6) to an associated adjusting rod (17) and to the holding-down ram (3) in alternation.

6 Claims, 4 Drawing Sheets

APPARATUS FOR FLANGING SHEET METAL BLANKS

BACKGROUND OF THE INVENTION

1. Field of the Invention

This invention relates to apparatus for flanging sheet metal blanks comprising a holding-down mechanism, which is adapted to hold down a sheet metal blank on a backing structure and comprises a holding-down shoe that is composed of a plurality of segments arranged in a row that is parallel to a bend line about which the blank is to be flanged. Said segments comprise mid-segment means and displaceable segments which are disposed on opposite sides of said mid-segment means and are slidably mounted on a track that is rigid with a holding-down ram and extends parallel to said bend line. Said displaceable segments are displaceable by means of two adjusting rods, which extend in the direction of said bend line on opposite sides of said mid-segment means.

2. Description of the Prior Art

From EP-A-0 105 091 it is known that the length of a holding-down shoe can be adapted to the length of the flange-forming portion of a sheet metal blank if the holding-down shoe comprises a plurality of displaceable segments, which are slidably mounted on a track which is parallel to the bend line about which the blank is to be flanged. The length of the shoe can be adapted in relatively coarse steps to the size of the blank in that a suitable number of displaceable segments are used in the shoe and those segments at the ends of the shoe which are not required are displaced out of the range of the blank to be flanged. To permit a fine adjustment, the shoe comprises a set of narrow mid-segments, which are pivotally movable for selective insertion into the row of active segments. In such an arrangement the length of each of the narrow mid-segments along the bend line will determine the increment in which the length of the shoe can be adapted to the length of the workpiece.

The movement of the displaceable segments to the mid-segments and the displacement of the end segments out of the range of the blank are performed by two adjusting mechanisms, which are disposed on each side of the mid-segments. One of said two adjusting mechanisms comprises an adjusting rod, which extends in the direction of the bend line and is connected by a tension-resisting joint to one of the displaceable segments which are nearest to the mid-segments. The other of said adjusting mechanisms comprises a one-way coupling finger and a screw drive, which extends parallel to said bend line and is operable to adjust said coupling finger. The latter can selectively be inserted between two adjacent displaceable segments to divide the segments on that side of the mid-segments into two parts, one of which can be displaced by an operation of the screw drive. By means of that combination of two adjusting mechanisms the segments can be adjusted to adapt the length of the shoe to the size of the workpiece. But the mechanisms for adjusting the segments represent an expensive and bulky structure and involve the disadvantage that considerable non-productive times are required for the idle movement of the coupling finger along the bend line to the position at which said finger is to be inserted.

In order to avoid said non-productive times for the idle adjsutment of the coupling finger, it has been proposed in EP A-0 186 909 to provide a flanging apparatus in which those intermediate displaceable segments which are disposed between each terminal displaceable segment and a mid-segment are mounted on a shaft which is parallel to the bend line and said intermediate segments can be non-rotatably connected to said shaft by a releasable key. In that case the shaft can be rotated to impart to selected intermediate displaceable segments a pivotal movement so as to insert them as required into the row of active segments of the holding-down shoe. Those intermediate displaceable segments which are not required at a time remain in an inoperative position because they are not locked to the shaft by the associated releasable key. In such an arrangement the length of the holding-down shoe is adapted to the length of the flange-forming portion of the blank in that selected intermediate displaceable segments are pivotally inserted into the row of segments and the terminal segments are then displaced into engagement with the inserted intermediate displaceable segments. For that purpose the two terminal segments of the holding-down shoe are operatively connected to a screw drive having a screw formed with oppositely handed screw threads so that the two terminal segments can be displaced equal distances in mutually opposite directions. In addition to the length adjustment in coarse steps by the insertion of selected intermediate displaceable segments, a fine adaptation can be effected by means of a set of narrow segment plates, which can be pivotally moved from an inoperative outer position to an operative position in which they are disposed between adjacent mid-segments. To permit such an insertion the mid-segments and those intermediate displaceable segments which adjoin the mid-segments must be displaced along the bend line. For this purpose the mid-segments are axially coupled to the shaft means on which the intermediate displaceable segments are mounted so that the mid-segments can be axially adjusted in unison with those shaft means, which consist of two shaft sections, which can axially be displaced in mutually opposite directions. That arrangement also involves relatively expensive means for adjusting the various segments.

SUMMARY OF THE INVENTION

It is an object of the invention to avoid the disadvantages outlined hereinbefore and to provide a flanging apparatus which is of the kind described first hereinbefore and is improved by the use of simple means in such a manner that the displaceable segments can be adjusted by compact means and non-productive times caused by an idle movement of adjusting mechanisms will not be required.

That object is accomplished in accordance with the invention in that each of the displaceable segments has associated with it a coupling for connecting the segment to the associated adjusting rod and to the holding-down ram in alternation.

By means of said couplings, which are associated with respective segments, those segments can be selected which will be displaced in unison with the associated adjusting rod and each movement of the adjusting rods will result in a movement of segments so that non-productive times will be avoided. Because the adjusting rod can be accommodated in the track which is provided on the holding-down ram and serves to guide the displaceable segments, the space required outside the holding-down ram will not be increased so that a restriction of the size of the workpieces to be flanged by such additional space requirement will be avoided.

In a preferred embodiment of the invention, a particularly simple structure is provided in that each coupling comprises a clamping member, which is movably mounted in and axially coupled to the associated segment and is movable between a first coupling position, in which the coupling member interlocks with the associated adjusting rod in a coupling opening thereof, and a second coupling position, in which the coupling member frictionally engages the holding-down ram so that the associated displaceable segment is axially coupled to said ram. When the clamping member interlocks with the adjusting rod in the coupling opening of the latter, the displaceable segment is no longer coupled to the ram so that the clamping member, which is movably mounted in and axially coupled to the segment, of the clamping member to the second clamping position will disconnect the associated sebment from the adjusting rod and will cause the segment to be clamped against the holding-down ram so that the adjusting rod can now be moved freely past that segment. Because selected displaceable segments can be frictionally coupled to the holding-down ram, the displaceable segments can infinitely be adjusted for an adaptation of the row of segments to the size of the workpiece. The use of a clamping member which in one coupling position positively couples the associated segment to the adjusting rod and in the other coupling position non-positively couples the associated segment to the holding-down ram in an axial direction affords an additional advantage that the flanging apparatus is highly reliable in operation because one connection will necessarily be eliminated when the other is made.

If each clamping member is biased in a clamping sense by at least one coupling spring and is displaceable by at least one coupling cylinder to the first coupling position for interlocking with the adjusting rod, a structurally simple mechanism will be obtained and a simple control system can be used because a single pressure fluid line will be required for each segment and each coupling can be controlled by a single control command.

To ensure that the clamping action will not constrain the segments as they are guided, the clamping members may be disposed between two track rails for guiding the displaceable segments and may have laterally extending clamping extensions which overlie said guide rails. In that case each displaceable segment can be frictionally coupled by symmetrically exerted clamping forces by which the coupling member is forced against the track rails whereas a canting of the segments will be avoided. As the clamping members will be moved from their second coupling position to the first in the direction of the holding-down movement of the holding-down ram, the adjusting rod can be displaced between the guide rails above the clamping members. In that case the coupling openings for receiving the clamping members to be interlocked with the adjusting rod must face downwardly.

DETAILED DESCRIPTION OF THE PREFERRED EMBODIMENT

Figure 1:
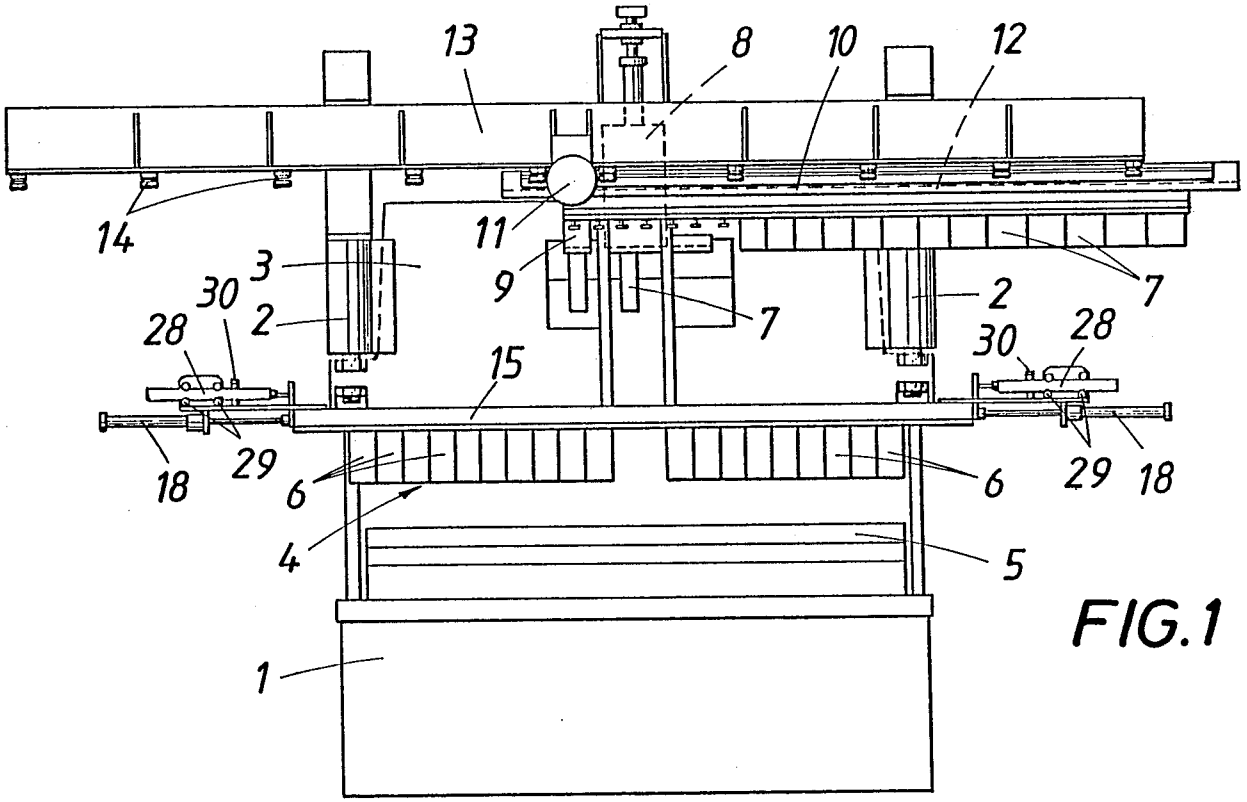
FIG. 1 is a diagrammatic front elevation showing a flanging apparatus in accordance with the invention.
Figure 2:
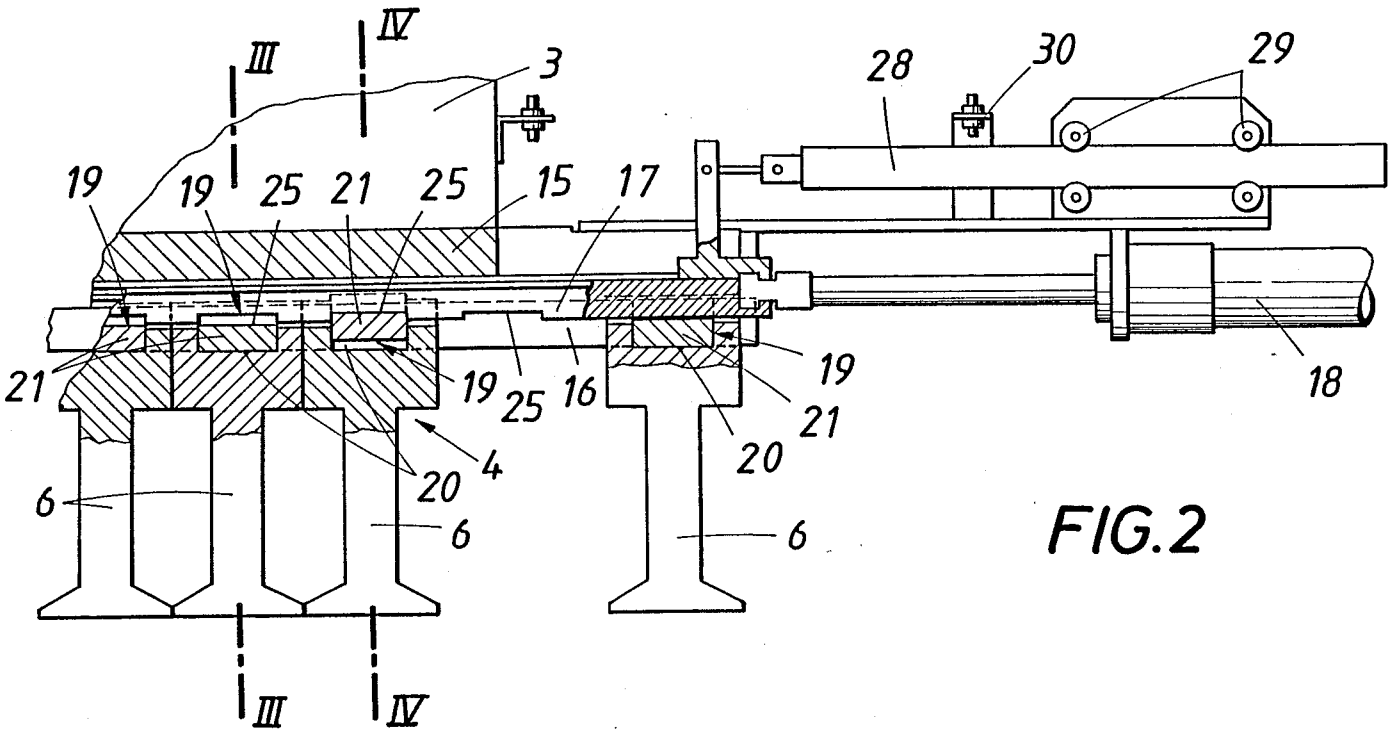
FIG. 2 is an enlarged fragmentary longitudinal sectional view showing a portion of the holding-down mechanism.

An illustrative embodiment of the invention is shown by way of example on the drawing.

The flanging apparatus shown comprises a frame 1, in which a holding-down ram 3 is displaceably mounted and is reciprocable by means of a cylinder 2. The holding-down ram 3 is comprised of a holding-down mechanism, which also comprises a holding-down shoe 4, which is operable by the holding-down ram 3 to force a sheet metal blank that is to be flanged against a backing structure 5. The holding-down shoe 4 defines a bend line, about which the blank can be flanged by a bending tool, which is not shown for the sake of clearness. That holding-down shoe 4 comprises a mid-segment 7 and a plurality of displaceable segments 6 disposed on opposite sides of the mid-segment 7. The segments 6 and 7 are arranged in a row, which is parallel to said bend line. The mid-segment 7 is connected to a slider 8, which is movable in the holding-down ram 3 in a vertical direction and operable to move the mid-segment 7 out of the row of segments 6 so that the mid-segment 7 can be replaced by another mid-segment 7 or the segments 6 can be displaced into the space which has been cleared in the shoe 4 by the mid-segment 7 that has been removed. The displaceable segments 6 will have to be displaced into said space if the holding-down shoe 4 is to be lifted from the blank between inturned edge flanges disposed at opposite ends of the holding-down shoe.

The means for replacing the mid-segment 7 comprise a segment-changing mechanism 9, which adjoins the slider 8 when it is in its inoperative upper position. The segment-changing mechanism 9 communicates with a magazine 10, in which different mid-segments 7 are stored. A mid-segment 7 which has been removed from the row of segments of the holding-down shoe 4 can be deposited in the magazine 10 in a selected storage position and another mid-segment 7 can substantially be taken from the magazine 10 and inserted into the row of segments. The magazine 10 is movable relative to the segment-changing mechanism 9 by means of a pinion 11, which is driven by a motor and in mesh with a rack 12 that is rigid with the magazine 10. The frame 1 carries a crossbar 13. The magazine is guided along the crossbar 13 by means of profiled rollers 14, which are mounted on the magazine 10 and roll on the crossbar 13.

The displaceable segments 6 disposed on opposite sides of the mid-segment 7 are carried by a segment carrier 15 and are slidable along a track, which is provided on the segment carrier 15 and extends along the bend line. That rack is constituted by two parallel track rails 16. The displaceable segments 6 have been inserted between the track rails 16 and are provided with laterally disposed recesses in sliding contact with the track rails 16. The displaceable segments 6 disposed on each side of the mid-segment 7 are displaceable by and adjusting rod 17, which is axially displaceably mounted in the segment carrier 15 and extends above the displaceable segments 6, which extend between the two track rails 16. Each adjusting rod 17 is axially movable by means of an actuating cylinder 18, which is secured to the segment carrier 15 at one end thereof.

Figure 3:
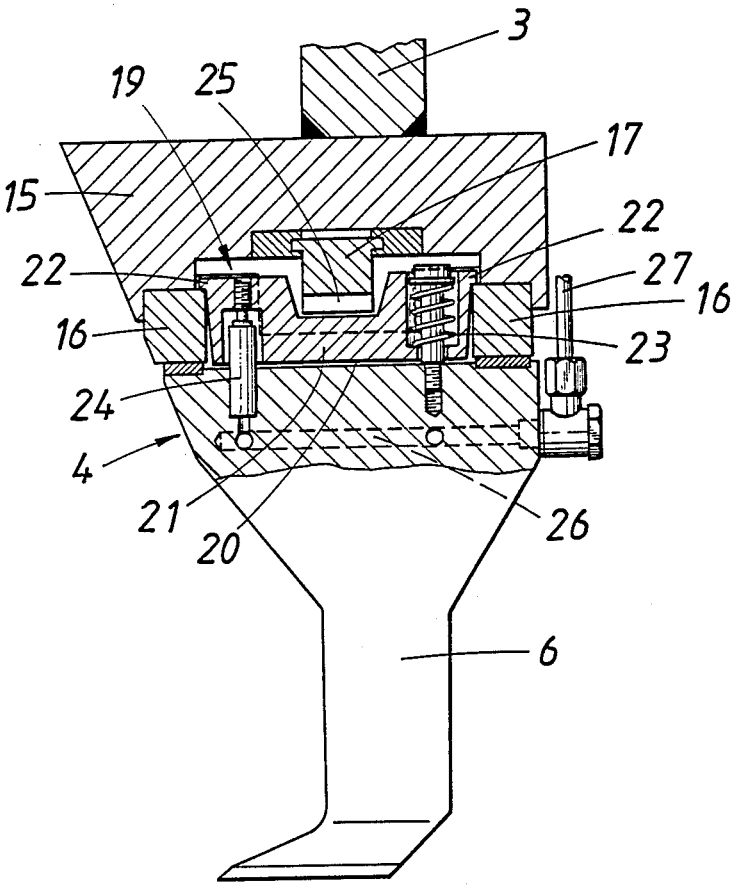
FIG. 3 is an enlarged sectional view taken on line III—III in FIG. 2
Figure 4:
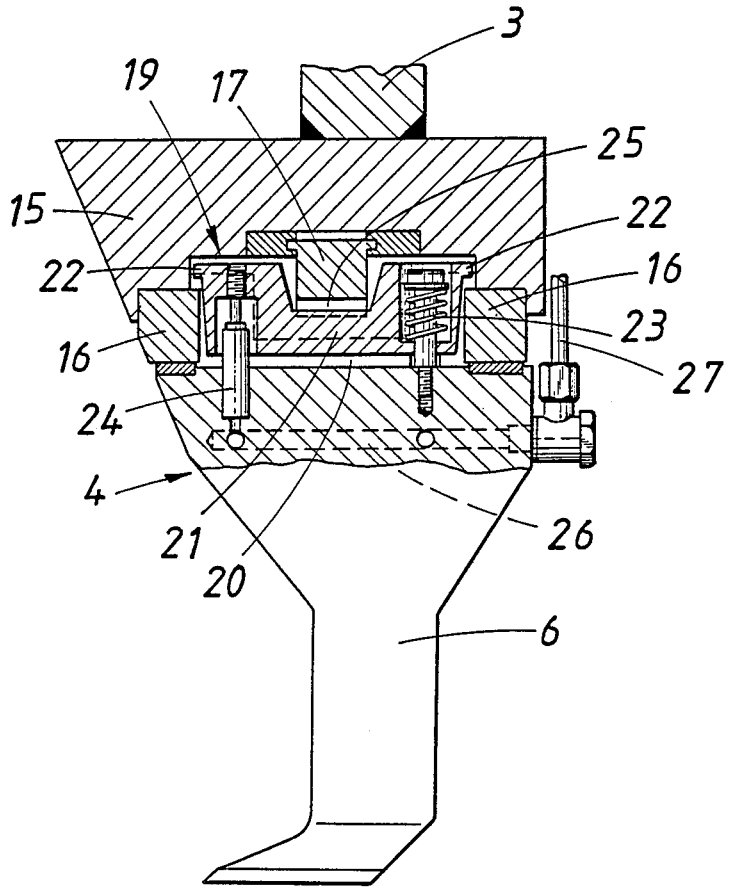
FIG. 4 is a sectional view which is similar to FIG. 3 but taken on line IV—IV in FIG. 2.

Each displaceable segment 6 has associated with it a coupling 19 for alternately coupling the segment 6 to the adjusting rod 17 and to the holding-down ram 3. Each of said couplings 19 comprises a clamping member 21, which is disposed between the two track rails 16 and has lateral clamping extensions 22 overlying said track rails 16. Each displaceable segment 6 has a guiding recess 20, which extends transversely to the adjusting rod 17 and is adapted to slidably receive the associated clamping member 21. Two clamping springs 23 are associated with each clamping member 21 and in the illustrated embodiment are disposed at opposite ends of the clamping member 21, which is rectangular in a top plan view. The coupling springs 23 urge the clamping member 21 to a second coupling position, which is shown in FIG. 3 and in which the clamping member 21 is clamped against the track rails 16 and the displaceable segment 6 is thus frictionally coupled to the holding-down ram 3. Two coupling cylinders 24 are provided at opposite eds of the other diagonal of the clamping member 21 and are operable to move the clamping member 21 against the force of the clamping springs 23 into a recess 25, which is formed in the adjusting rod 17 on the underside thereof, so that the coupling member 21 is then interlocked with the adjusting rod 17 in the position shown in Fiure 4. When the adjusting rod 17 is axially displaced by the associated actuating cylinder 18, those clamping members 21 which interlock with the adjusting rod 17, and are uncoupled from the guide rails 16 will cause the associated displaceable segments 6 to move in unison with the adjusting rod 17. In dependence on the operation of the coupling cylinders 24, different groups of displaceable segments 6 can be displaced so that the length of the holding-down shoe can be adapted to the size of the desired workpiece whereas those displaceable segments 6 which are not required at a time are shifted out of the intended holding-down range of the holding-down shoe.

Pressure fluid can be supplied to each coupling cylinder 24 through bores 26, which formed in each segment 6 and are supplied with fluid under pressure by a pressure fluid line 27. The couplings 19 can be controlled in a particularly simple manner because they will move to one or the other of their coupling positions in dependence on the supply of pressure fluid to the pressure fluid line 27, which can be controlled by a control valve in response to a single control signal.

To ensure that the coupling recesses 25 in the adjusting rod 17 can be moved to positions in which they register with the clamping members 21 associated with the displaceable segments 6, the displacment of the adjusting rod 17 must be measured. It must be borne in mind that the use of mid-segments 7 having differential axial widths may have the result that the several displaceable segments 6 are displaced to different axial positions. For that reason the adjusting rod 17 is connected to an incremental scale 28, which is movably mounted in a roller guide 29 and cooperates with a sensing head 30 so that the displacement of the adjusting rod 17 can be controlled by a computer in a simple manner.

It will be understood that apparatus in accordance with the invention can be provided in that the holding-down mechanism in accordance with the invention is replaced for another holding-down mechanism in existing apparatus for flanging sheet metal blanks.

What is claimed is:

1. In apparatus for flanging sheet metal blanks comprising a backing structure adapted to support a sheet metal blank as it is flanged and a holding-down mechanism for holding down said sheet metal blank on said backing structure and for defining on said blank a bend line, which mechanism comprises a holding-down shoe comprising a plurality of segments arranged in a straight row, a holding-down ram, which is operable to force down said shoe so that said segments engage said blank on said backing structure and define on said blank a bend line which is parallel to said row, and track means rigid with said ram and extending parallel to said row, wherein said segments comprise mid-segment means and two sets of displaceable segments disposed on opposite sides of said mid-segment means and displaceably guided by said track means along the latter, said mechanism comprises two adjusting rods, each of which is operable to move at least one of said displaceable segments of one of said sets along said track means, the improvement comprising a plurality of couplings, each of which is on said displaceable segment and is operable to couple one of said displaceable segments alternately to one of said adjusting rods and to said ram.

2. The improvement set forth in claim 1, wherein each of said couplings comprises a clamping member, which is axially coupled to the associated displaceable segment and is mounted therein for a movement between first and second coupling positions in a direction which is transverse to said adjusting rod length, each of said adjusting rods is formed with a plurality of axially spaced apart coupling openings, each of which is configured to receive one of said clamping members in said first clamping position thereof to positively lock said clamping member to said adjusting rod, and actuating means for moving each of said clamping members in alternation to said first and second coupling positions and for urging said clamping member in said second coupling position against said ram in fictional engagement therewith.

3. The improvement set forth in claim 2, wherein said actuating means of each of said couplings comprise clamping spring means for urging said clamping member in said second coupling position against said ram in frictional engagement therewith and coupling cylinder means for displacing said clamping member against the force of said clamping spring means to said first clamping position.

4. The improvement set forth in claim 2, wherein said track means comprise two laterally spaced apart track rails extending along said row and each of said clamping members extends between said track rails and has two extensions, which extend laterally over said track rails and are arranged to frictionally engage said track rails in said second clamping position.

5. The improvement set forth in claim 4, wherein each of said adjusting rods is formed with said coupling openings on the underside of said rod.

6. A holding-down mechanism for holding down a sheet metal blank on a backing structure of apparatus for flanging said blank about a bend line, which mechanism comprises a holding-down shoe comprising a plurality of segments arranged in a straight row, a holding-down ram, which is operable to force down said shoe so that said segments are adapted to engage said blank on said backing structure and define on said blank a bend line which is parallel to said row, and track means rigid with said ram and extending parallel to said row, wherein said segments comprise mid-segment means and two sets of displaceable segments disposed on opposite sides of said mid-segment means and displaceably guided by said track means along the latter, said mechanism comprises two adjusting rods, each of which is operable to move at least one of said displaceable segments of one of said sets along said track means, the improvement comprising a plurality of couplings each of which is on said displaceable segment and is operable to couple one of said displaceable segments alternately to one of said adjusting rods and to said ram.

* * * * *